US008291837B2

(12) United States Patent
Kirkpatrick

(10) Patent No.: US 8,291,837 B2
(45) Date of Patent: Oct. 23, 2012

(54) PALLET MAINTAINING SURFACE ELEMENT UNDER COMPRESSION

(76) Inventor: James Thomas Kirkpatrick, Belfast (GB)

( * ) Notice: Subject to any disclaimer, the term of this patent is extended or adjusted under 35 U.S.C. 154(b) by 9 days.

(21) Appl. No.: 12/370,342

(22) Filed: Feb. 12, 2009

(65) Prior Publication Data

US 2009/0255446 A1 Oct. 15, 2009

(30) Foreign Application Priority Data

Feb. 14, 2008 (GB) ..... 0802711.2

(51) Int. Cl.
*B65D 19/12* (2006.01)

(52) U.S. Cl. ..... 108/56.1; 108/51.11

(58) Field of Classification Search ..... 108/51.11, 108/51.3, 56.1, 56.3, 57.33, 27; 248/346.02; 206/386, 600, 599
See application file for complete search history.

(56) References Cited

U.S. PATENT DOCUMENTS

| | | | | | |
|---|---|---|---|---|---|
| 1,749,270 | A | * | 3/1930 | Young | 108/51.11 |
| 1,790,019 | A | * | 1/1931 | Raymond | 108/51.11 |
| 2,311,280 | A | * | 2/1943 | Quayle | 108/57.1 |
| 2,817,485 | A | * | 12/1957 | White et al. | 108/57.1 |
| 3,118,400 | A | * | 1/1964 | Kemp, Jr. | 108/57.1 |
| 3,149,586 | A | * | 9/1964 | Kemp, Jr. et al. | 108/57.2 |
| 3,157,423 | A | * | 11/1964 | Brie, Sr. | 108/56.1 |
| 3,207,096 | A | * | 9/1965 | Munroe | 108/51.11 |
| 3,238,901 | A | * | 3/1966 | Haaland | 108/56.1 |
| 3,552,329 | A | * | 1/1971 | Parris | 108/51.11 |
| 3,626,869 | A | * | 12/1971 | Colas | 108/51.11 |
| 3,645,215 | A | * | 2/1972 | Kirkpatrick | 108/57.23 |
| 3,684,632 | A | | 8/1972 | Pedraza | |
| 4,220,100 | A | | 9/1980 | Palomo et al. | |
| 4,715,294 | A | * | 12/1987 | Depew | 108/57.17 |
| 5,197,395 | A | * | 3/1993 | Pigott et al. | 108/56.1 |
| 5,351,628 | A | * | 10/1994 | Breezer et al. | 108/56.1 |
| 6,192,807 | B1 | * | 2/2001 | Mason | 108/51.11 |
| 6,234,086 | B1 | * | 5/2001 | Mason | 108/51.11 |
| 6,564,725 | B2 | * | 5/2003 | Hale | 108/57.25 |
| 6,622,642 | B2 | * | 9/2003 | Ohanesian | 108/57.25 |
| 7,455,017 | B2 | * | 11/2008 | Carpenter et al. | 108/51.11 |
| 2005/0081763 | A1 | * | 4/2005 | Ramirez von Holle et al. | 108/56.1 |

FOREIGN PATENT DOCUMENTS

GB 1255798 A 12/1971

* cited by examiner

*Primary Examiner* — Jose V Chen
(74) *Attorney, Agent, or Firm* — Standley Law Group LLP

(57) ABSTRACT

A pallet for the stable transport of goods; the pallet comprising at least one surface element, and a plurality of side elements arranged, in use, to maintain the at least one surface element under compression. Preferably the at least one surface element comprises a planar body, which is generally parallelepiped in shape, and having a periphery defined by peripheral edges. Preferably a portion of each side element is shaped and dimensioned to accommodate a respective peripheral edge of the at least one surface element whereby the at least one surface element is retained within the side elements. Preferably the perimeter length of the at least one surface element exceeds the perimeter length defined by the assembled side elements whereby the at least one surface element is held under compression within the frame assembly of the side elements.

18 Claims, 5 Drawing Sheets

PALLET MAINTAINING SURFACE ELEMENT UNDER COMPRESSION

CROSS-REFERENCE TO RELATED APPLICATIONS

This application is entitled to, and claims, a benefit of a right of priority under 35 USC §119 from United Kingdom patent application 0802711.2, filed on 14 Feb. 2008, the content of which is incorporated by reference as if fully recited herein.

TECHNICAL FIELD

The present invention relates to a pallet, in particular to a pallet that serves as a base foundation for the stable transport of goods.

BACKGROUND OF THE ART

It is an object of the present invention to provide a pallet with improved mechanical strength for facilitating the stable transport of goods. In particular, it is an object of the present invention to provide a pallet having the mechanical strength required to accommodate a plurality of goods in the form of a unit load, with reduced risk of damage or destruction of the pallet due to then increased weight associated with the load. Accordingly, the present invention provides a pallet that can accommodate a unit load of increased weight with reduced risk of damage or destruction.

SUMMARY

According to the present invention there is provided a pallet for the stable transport of goods; the pallet comprising at least one surface element, and a plurality of side elements arranged, in use, to maintain the at least one surface element under compression.

In one embodiment the pallet comprises four side elements, and at least one surface element.

Preferably the ends of adjacent side elements are interengagable. More preferably the side elements are connected together by a fixing, such as a screw fixing.

Each side element may comprise inner and outer faces, and first and second opposing end faces; whereby, the side elements are arranged such that the first end face of one side element engages the inner face of an adjacent side element, optionally, adjacent its second end face. Each second end face of the adjacent side element may be continuous with an outer face of the one side element.

Each side element may comprise a frame, which is generally parallelepiped in shape. Optionally, at least one cross-member can be provided between opposing sides of the frame.

Preferably the at least one surface element comprises a planar body, which is generally parallelepiped in shape, and having a periphery defined by peripheral edges. Preferably a portion of each side element is shaped and dimensioned to accommodate a respective peripheral edge of the at least one surface element whereby the at least one surface element is retained within the side elements. Said portion of each side of the side element may be generally curved or U-shaped in transverse cross-section to receive a peripheral edge of the at least one surface element. Preferably the perimeter length of the at least one surface element exceeds the perimeter length defined by the assembled side elements whereby the at least one surface element is held under compression within the frame assembly of the side elements.

In one embodiment, the pallet may comprise two spaced-apart surface elements. Preferably the pallet further comprises a support between the two surface elements. The support may be adjustable to vary the distance between the two surface elements. Preferably the support is adjustable to decrease the distance between the two surface elements. Alternatively the support may be adjustable to increase the distance between the two surface elements.

Preferably, in use, the four side elements are arranged in an array, wherein a first end of a first side element is located adjacent a second end of a second side element; the opposing (first) end of the second side element is located adjacent a second end of a third side element; the opposing (first) end of the third side element is located adjacent a second end of a fourth side element; and the opposing (first) end of the fourth side element is located adjacent the opposing (second) end of the first side element.

Optionally, the at least one surface element is continuous. Alternatively, the at least one surface element comprises a mesh or grid.

Preferably, at least one aperture is provided in the, in use, ground-engaging surface element. Further preferably, four apertures are provided in the, in use, ground-engaging surface element, wherein each aperture is shaped and dimensioned to facilitate use of pallet truck, or similar device. Most preferably, each aperture is shaped and dimensioned to allow the ground-engaging components, such as ground engaging wheels, of the pallet truck, or similar device, to engage the ground during normal operation.

Preferably, each side element is formed from a material such as metal. More preferably, each side element is formed from a metal alloy, such as steel. However, it will be seen that any material that can impart the required mechanical strength may be used, and can be selected by one skilled in the art.

Preferably, each surface element is formed from a material such as wood. More preferably, each surface element is formed from an engineered wood, such as plywood. However, it will be seen that any material that can impart the required mechanical strength may be used, and can be selected by one skilled in the art.

Preferably, the support is formed from a material such as metal. More preferably, the support is formed from a metal alloy, such as steel. However, it will be seen that any material that can impart the required mechanical strength may be used, and can be selected by one skilled in the art.

BRIEF DESCRIPTION OF THE DRAWINGS

An embodiment of the invention will now be described, by way of example, with reference to the accompanying drawings, in which.

DETAILED DESCRIPTION

Figure 1:
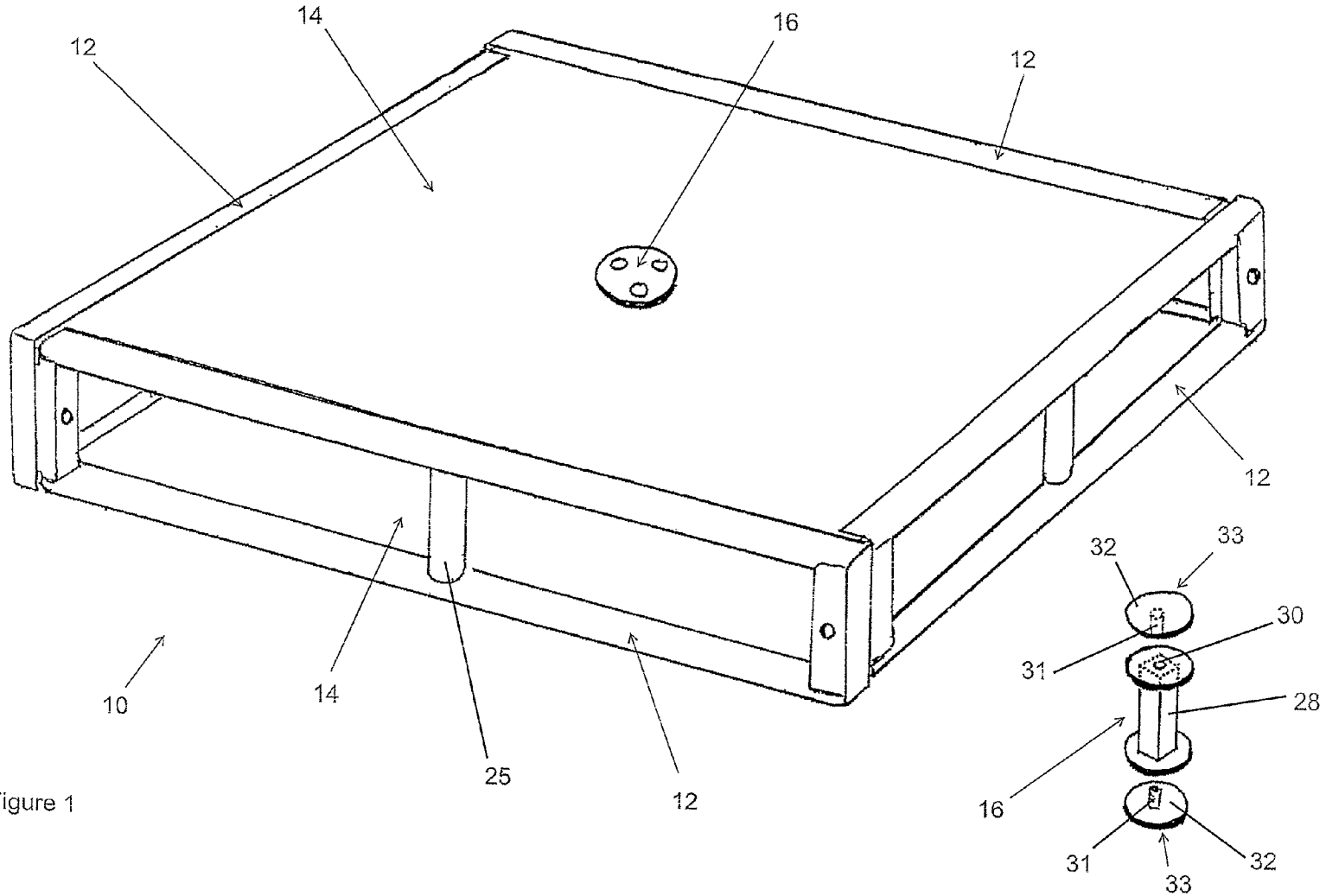
FIG. 1 is a perspective view of a pallet according to a preferred embodiment of the present invention, depicting the pallet assembled for use.

Referring now to FIG. 1 of the drawings, there is shown a pallet 10 according to a preferred embodiment of the invention. The pallet 10 comprises four side elements 12, two surface elements 14, and a support 16, which are assembled to provide a base foundation, which can accommodate a unit load (not shown).

Figure 2:
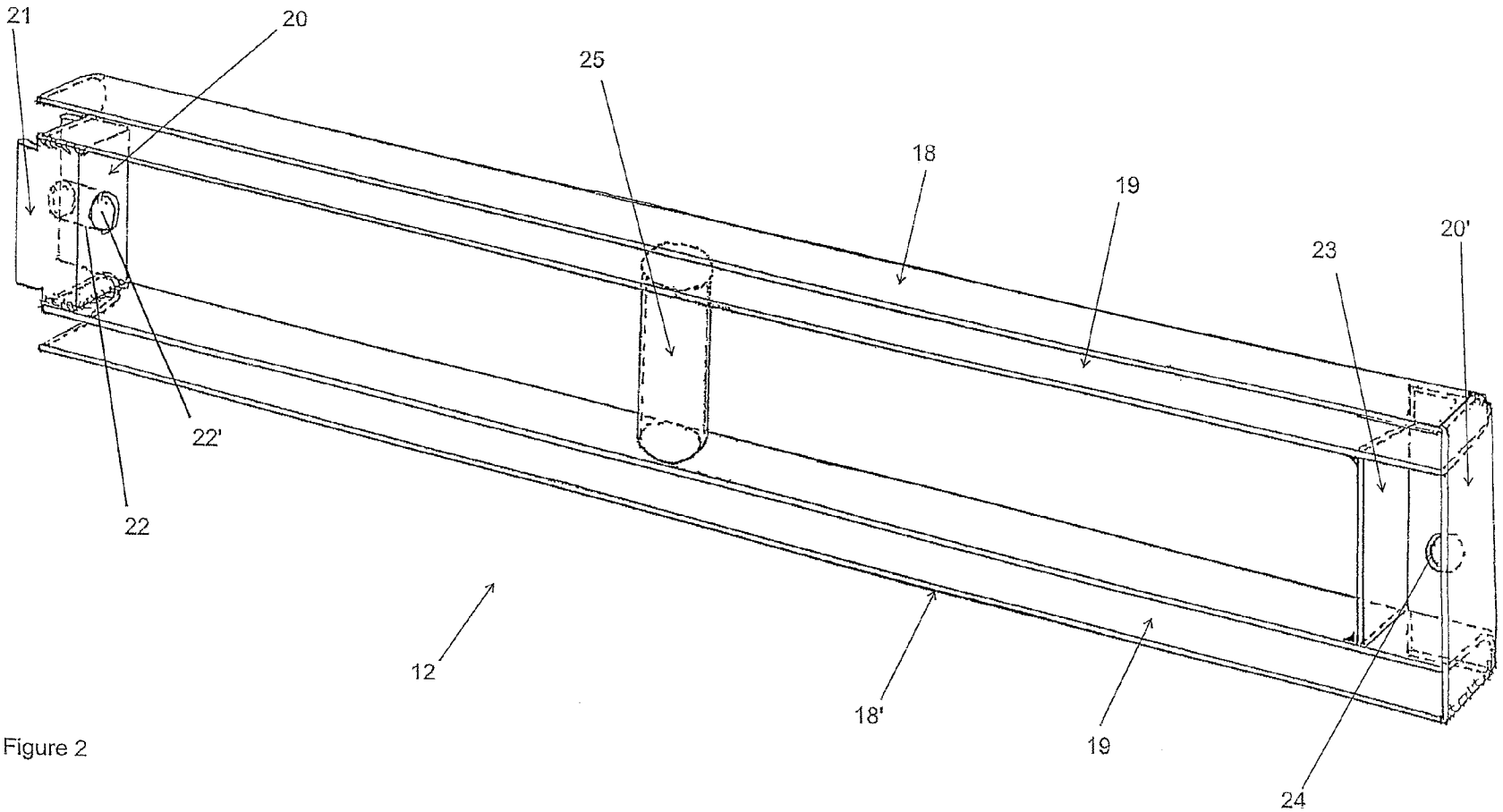
FIG. 2 is a perspective view of a side element of a pallet.
Figure 3B:
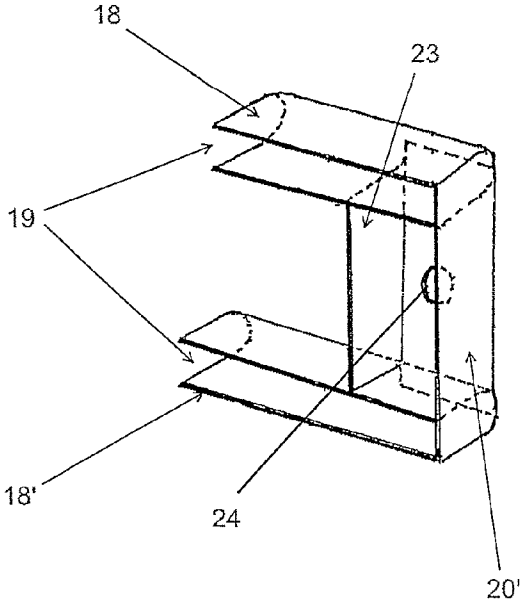
FIG. 3B is a perspective view of a second end of the side element of FIG. 2.
Figure 3A:
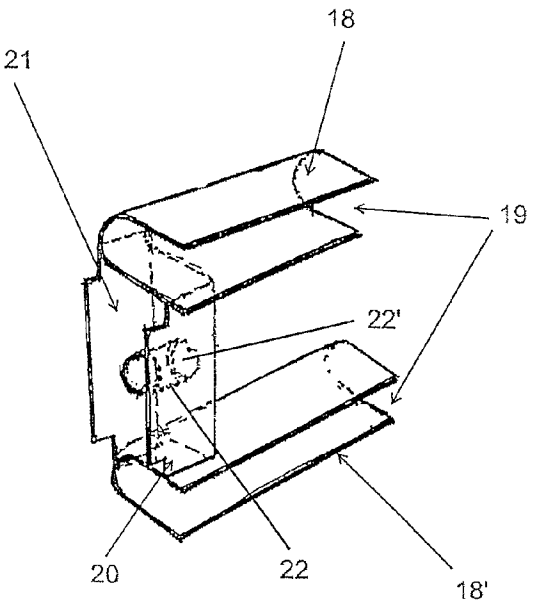
FIG. 3A is a perspective view of a first end of the side element of FIG. 2.

FIG. 2 is a perspective view of a side element 12 of the pallet 10. The side element 12 comprises a generally rectangular frame having two generally parallel opposing sides 18, 18', and two generally parallel opposing ends 20,20'. Each of the opposing sides 18, 18' comprises an elongate channel, which is generally U-shaped in transverse cross-section. The opposing sides 18, 18' are oriented such that the open mouth of the "U" 19 of each opposing side 18, 18' is located on the same face of the side element 12, which is defined herein as an in use, inner face of the side element 12. Each of the opposing ends 20, 20' is located adjacent a respective end of the opposing sides 18, 18'. A first opposing end 20 has an open face 21 at the respective end of the side element 12. A projection 22 extends through the opposing end 20 and defines a generally cylindrical elongate aperture 22', the longitudinal axis of which is generally parallel to the longitudinal axis of the side element 12, FIG. 3A.

The inner surface of the projection 22 has a screw thread. A second opposing end 20' has an open face 23 at the in use, inner face of the side element 12. A generally circular aperture 24 is provided adjacent the end 20' of the side element 12, and is located on a face of the side element 12 opposing the open face 23, FIG. 3B, which is defined herein as an in use, outer face of the side element 12. A cross-member 25 extends between, and generally perpendicular to, each of the opposing sides 18, 18'. The cross-member 25 has the form of a generally hollow cylindrical tube.

Figure 4:
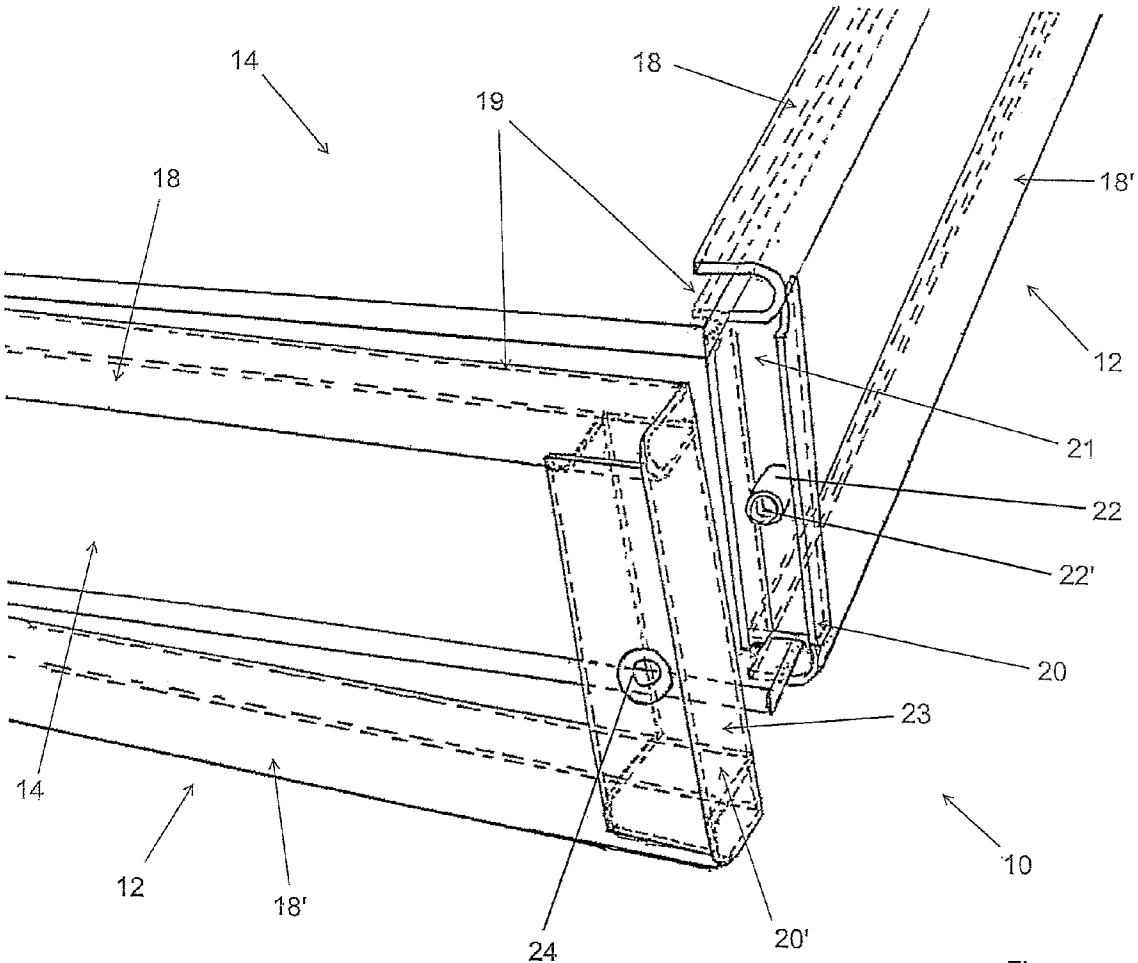
FIG. 4 is a perspective view depicting how the side elements and surface elements of the pallet of FIG. 1 are assembled.

FIG. 4 is a perspective view depicting how the side elements 12 and surface elements 14 of the pallet 10 are assembled. Each peripheral edge of a first surface element 14 is inserted into, and locates in; a respective opposing side 18' of each side element 12, via the open mouth of the "U" 19. The first surface element 14 thereby serves as an, in use, lower, ground-engaging face of the pallet 10. Similarly, each peripheral edge of a second surface element 14 is inserted into, and locates in; a respective opposing side 18 of each side element 12, via the open mouth of the "U" 19. The second surface element 14 thereby serves as an, in use, upper, load-engaging face of the pallet 10.

Once assembled, an opposing end 20 of each side element 12 is in side-by-side relationship with an opposing end 20' of an adjacent side element 12, forming a contiguous assembly around the perimeter of each surface element 14. Accordingly, the generally circular aperture 24 of the opposing end 20' is juxtaposed in side-by-side relationship to the respective end of the projection 22 of the opposing end 20, such that the generally cylindrical elongate aperture 22' and the aperture 24 are coaxial. A suitable fastening device, such as a screw (not shown), can then be used to fasten each side element 12 to an adjacent side element 12 via the screw thread on the inner surface of the projection 22 of the opposing end 20. Resultantly, the fastening device at each interface between adjacent side elements 12, is oriented substantially perpendicular to the fastening device at an adjacent interface between side elements 12.

Referring again to FIG. 1 of the drawings, there is shown a support 16, which comprises a central body 28 and two external members 33. The central body 28 is generally cylindrical in shape. An elongate aperture 30 runs along the longitudinal axis, and opens at each end, of the central body 28. The internal surface of the elongate aperture 30 comprises a screw thread. Each of the external members 33 comprises a disc 32 and a screw fixing 31. The screw fixing 31 can locate in the elongate aperture 30 of the central body 28. In use, the central body 28 is located between each of the surface elements 14. The screw fixing 31 of each external member 32 passes through an aperture in the surface element 14 (not shown) and locates in the elongate aperture 30 of the central body 28. Fastening of each external member 32 results in each disc 32 being brought sequentially into closer proximity with the central body 28. Once fastened, each disc 32 can be secured to the respective surface element 14 to impede unfastening of the disc 32 from the central body 28.

Figure 5:
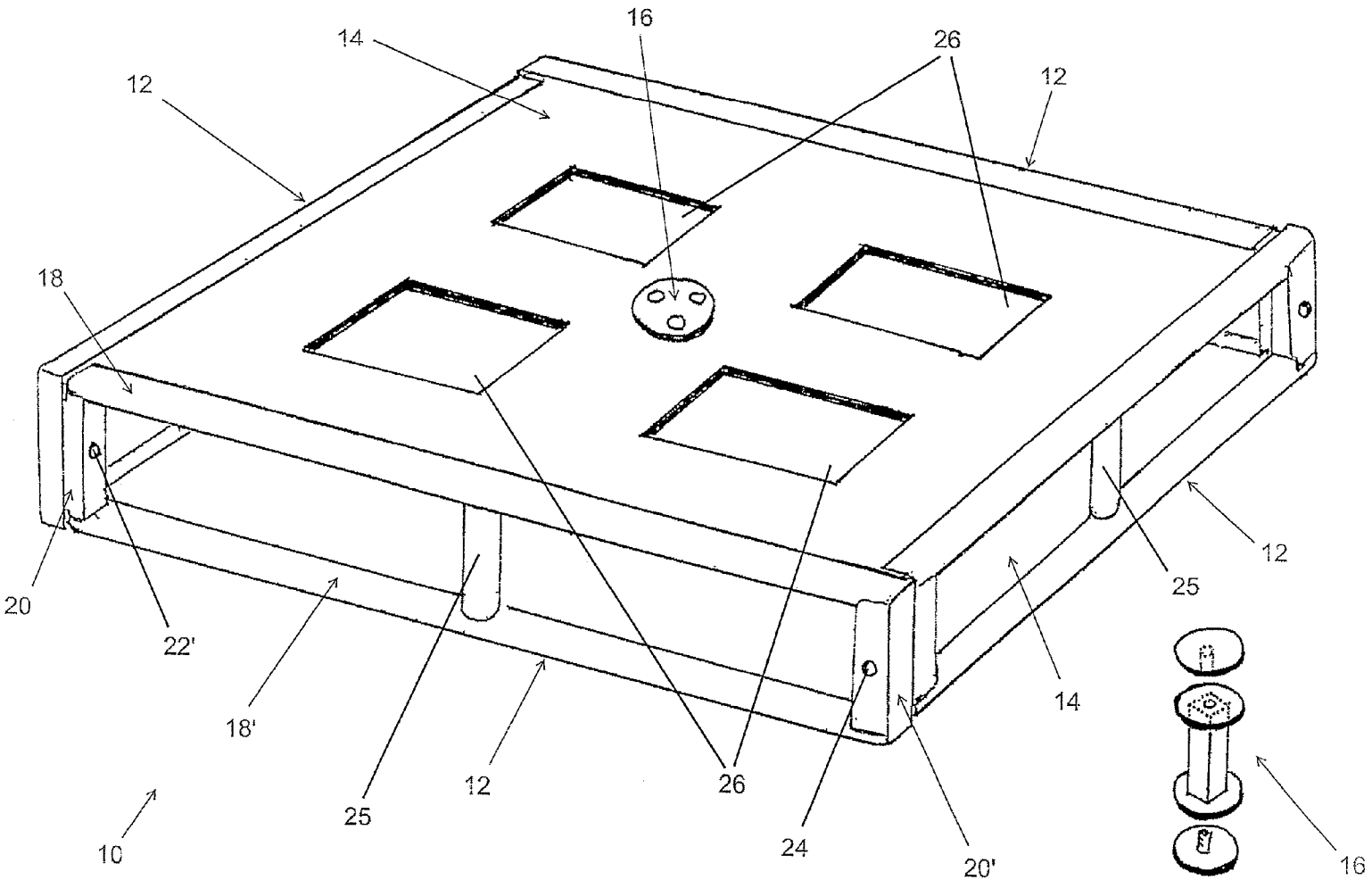
FIG. 5 is a perspective view of the in use underside of the pallet of FIG. 1.

FIG. 5 is a perspective view of the in use underside of the pallet 10. Four apertures 26 are provided in the, in use, ground-engaging surface element 14 to facilitate the use of a pallet truck, pallet jack, or similar device. Each aperture 26 allows the ground-engaging components of the pallet truck, pallet jack, or similar device to pass through the surface element 14, and to engage the ground during operation of the device.

Preferably, the perimeter length of each surface element 14 slightly exceeds the perimeter length defined by the assembled side elements 12. Accordingly, the sequential fastening of each side element 12 to, in turn, its adjacent side element 12, will ultimately result in the application of a compressive force to the sides of each surface element 14 by the side elements 12 such that each of the surface elements 14 is held under compression within the frame assembly of the side elements 12. Preferably, the distance between the two surface elements 14 exceeds the longitudinal length of the central body 28 of the support 16. Alternatively the longitudinal length of the central body 28 exceeds the distance between the two surface elements 14

Furthermore, the sequential perpendicular orientation of the fastening device at each interface between adjacent side elements 12 distributes the weight of a load applied to the pallet 10 in a continuous manner around the perimeter of the pallet, reducing pressure being applied exclusively to a discrete location on the pallet 10, and the resultant chance of damage or destruction.

The use of identical side elements 12 allows each element to be easily manufactured, and lends itself to easy assembly of the pallet 10. Each component of the pallet 10 can also be easily replaced following damage to the individual component, without the need to destroy or replace the entire pallet 10. Moreover, the pallet 10 is accessible by a forklift, pallet truck, pallet jack, or similar device, from any of the four sides of the pallet 10.

Accordingly, the present invention provides a modular system of connectable elements, which can be assembled to provide a pallet, which acts as a base foundation, which can accept a load of goods for stable transportation. The uncomplicated and lightweight design of the present invention facilitates easy manufacture and assembly, and allows for simple replacement of individual parts following damage or destruction. The sequential manner by which the components of the pallet are fastened together bestows the pallet with the mechanical strength required to accommodate the weight of a unit load, without damage or destruction of the pallet.

The invention is not limited to the embodiment described herein but can be amended or modified without departing from the scope of the present invention.

What is claimed is:

1. A pallet for the stable transport of goods; the pallet comprising:

at least one surface element, defining a plane with a perimeter length; and four side elements, each comprising an inner and an outer face and a first and a second opposing end face, the side elements assembled into a rigid frame that forms a contiguous assembly around the perimeter of each respective at least one surface element such that the first end face of each side element engages the inner face of an adjacent side element, where a perimeter length defined by the rigid frame when assembled is less than the perimeter length of each respective at least one surface element, maintaining each respective at least one surface element under compression in the plane thereof.

2. The pallet of claim 1, wherein:

the ends of adjacent side elements are inter-engagable.

3. The pallet of claim 2, wherein:

a fixing, such as a screw fixing, connects the side elements together.

4. The pallet of claim 3, wherein:

each side element comprises a frame, which is generally parallelepiped in shape.

5. The pallet of claim 3, wherein:

the at least one surface element comprises a planar body, which is generally parallelepiped in shape, and having a periphery defined by peripheral edges.

6. The pallet of claim 3, wherein:

the pallet comprises two spaced-apart surface elements.

7. The pallet of claim 6, further comprising:

a support between the two surface elements.

8. The pallet of claim 1, wherein:

each second end face of the adjacent side element is continuous with an outer face of the one side element.

9. The pallet of claim 1, wherein:

each side element comprises a frame, which is generally parallelepiped in shape.

10. The pallet of claim 1, wherein:

the at least one surface element comprises a planar body, which is generally parallelepiped in shape, and having a periphery defined by peripheral edges.

11. The pallet of claim 10, wherein:

a portion of each side element is shaped and dimensioned to accommodate a respective peripheral edge of the at least one surface element whereby the at least one surface element is retained within the side elements.

12. The pallet of claim 11, wherein:

said portion of each side of the side element is generally curved or U-shaped in transverse cross-section.

13. The pallet of claim 1, wherein:

the pallet comprises two spaced-apart surface elements.

14. The pallet of claim 13, further comprising:

a support between the two surface elements.

15. The pallet of claim 14, wherein:

the support is adjustable to vary the distance between the two surface elements.

16. The pallet of claim 15, wherein:

the support is adjustable to decrease the distance between the two surface elements.

17. The pallet of claim 1, wherein:

the first end face of one side element engages the inner face of the adjacent side element adjacent the second end face thereof.

18. A pallet for the stable transport of goods; the pallet comprising:

two spaced-apart surface elements, each surface element comprising a planar body, which is generally parallelepiped in shape and has a periphery defined by peripheral edges;

four side elements arranged, in use, to maintain each of the two surface elements under compression, the ends of adjacent side elements being interengaged to form a rigid frame, generally parallelepiped in shape, which forms a contiguous assembly around the periphery of each of the surface elements, the ends of adjacent side elements being fastened together to maintain each surface element under compression in the plane thereof; and a support between the two surface elements.

* * * * *